US009375602B2

(12) United States Patent
Krull

(10) Patent No.: US 9,375,602 B2
(45) Date of Patent: Jun. 28, 2016

(54) EXERCISE DUMBBELLS

(71) Applicant: Mark A. Krull, New Braunfels, TX (US)

(72) Inventor: Mark A. Krull, New Braunfels, TX (US)

(73) Assignee: NAUTILUS, INC., Vancouver, WA (US)

( * ) Notice: Subject to any disclaimer, the term of this patent is extended or adjusted under 35 U.S.C. 154(b) by 192 days.

(21) Appl. No.: 13/836,908

(22) Filed: Mar. 15, 2013

(65) Prior Publication Data

US 2014/0274596 A1 Sep. 18, 2014

(51) Int. Cl.

*A63B 21/072* (2006.01)
*A63B 21/075* (2006.01)
*A63B 71/06* (2006.01)

(52) U.S. Cl.

CPC ..... *A63B 21/0724* (2013.01); *A63B 21/075* (2013.01); *A63B 21/0726* (2013.01); *A63B 71/0619* (2013.01); *A63B 2220/52* (2013.01)

(58) Field of Classification Search

CPC ..... A63B 21/0724; A63B 21/0726; A63B 21/075; A63B 2220/52; A63B 71/0619

See application file for complete search history.

(56) References Cited

U.S. PATENT DOCUMENTS

| | | | | |
|---|---|---|---|---|
| 3,771,785 | A | 11/1973 | Speyer | |
| 4,529,198 | A | 7/1985 | Hettick, Jr. | |
| 4,822,034 | A | 4/1989 | Shields | |
| 5,284,463 | A | 2/1994 | Shields | |
| 5,637,064 | A | 6/1997 | Olson et al. | |
| 5,769,762 | A | 6/1998 | Towley, III et al. | |
| 5,839,997 | A | 11/1998 | Roth et al. | |
| 6,033,350 | A | 3/2000 | Krull | |
| 6,228,003 | B1 | 5/2001 | Hald et al. | |
| 6,261,022 | B1 | 7/2001 | Dalebout et al. | |
| 6,322,481 | B1 | 11/2001 | Krull | |
| 6,540,650 | B1 | 4/2003 | Krull | |
| 6,669,606 | B2 | 12/2003 | Krull | |
| 6,679,816 | B1 | 1/2004 | Krull | |
| 6,746,381 | B2 | 6/2004 | Krull | |
| 6,855,097 | B2 | 2/2005 | Krull | |
| 6,997,856 | B1 | 2/2006 | Krull | |
| 7,077,791 | B2 | 7/2006 | Krull | |
| 7,578,771 | B1 * | 8/2009 | Towley, III | A63B 1/04 482/104 |
| 2002/0128127 | A1 * | 9/2002 | Chen | A63B 21/0726 482/106 |
| 2003/0100406 | A1 * | 5/2003 | Millington | A63B 21/1469 482/1 |
| 2005/0065003 | A1 * | 3/2005 | Klotzki | A63B 21/072 482/107 |
| 2013/0090212 | A1 * | 4/2013 | Wang | A63B 71/0619 482/8 |
| 2013/0288859 | A1 * | 10/2013 | Watterson | A63B 24/0062 482/8 |

* cited by examiner

*Primary Examiner* — Oren Ginsberg
*Assistant Examiner* — Sundhara Ganesan
(74) *Attorney, Agent, or Firm* — Dorsey & Whitney LLP

(57) ABSTRACT

An exercise dumbbell includes a handle member and weights positioned at opposite ends of the handle member. An additional weight forms a box about the handle member and the end weights. At least one weight selector is movably mounted on the handle member to selectively engage the end weights. At least one connector is movably mounted on the box weight to selectively engage the handle member. A circuit includes at least one sensor that generates a signal that represents how much force is required to lift the handle member and any weights secured thereto, and a display that displays the force. At least one latch prevents movement of the selector and/or the connector when the handle member is removed from a support base for the weights and the handle member.

23 Claims, 11 Drawing Sheets

EXERCISE DUMBBELLS

FIELD OF THE INVENTION

The present invention relates to exercise equipment and in a preferred application, to exercise dumbbells.

BACKGROUND OF THE INVENTION

Past efforts have led to various inventions directed toward adjustable weight exercise devices. Some examples of such efforts in the field of free weights are disclosed in U.S. Pat. No. 3,771,785 to Speyer; U.S. Pat. No. 4,529,198 to Hettick, Jr.; U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; U.S. Pat. No. 5,839,997 to Roth et al.; U.S. Pat. No. 6,033,350 to Krull; U.S. Pat. No. 6,228,003 to Hald et al.; U.S. Pat. No. 6,261,022 to Dalebout et al.; U.S. Pat. No. 6,322,481 to Krull; U.S. Pat. No. 6,540,650 to Krull; U.S. Pat. No. 6,669,606 to Krull; U.S. Pat. No. 6,679,816 to Krull; U.S. Pat. No. 6,746,381 to Krull; U.S. Pat. No. 6,855,097 to Krull; U.S. Pat. No. 6,997,856 to Krull; and U.S. Pat. No. 7,077,791 to Krull. Despite these advances and others in the field of weight lifting equipment, room for continued improvement remains with respect to selecting different combinations of weight for use on exercise dumbbells and the like.

SUMMARY OF THE INVENTION

The present invention allows a person to adjust weight resistance by releasably securing different amounts of mass to a handle assembly. A preferred embodiment of the present invention may be described in terms of an exercise dumbbell comprising a handle assembly including a handle, first weights disposed at a first end of the handle assembly, and second weights disposed at an opposite, second end of the handle assembly, and at least one selector on the handle assembly for selectively connecting the weights to the handle assembly.

According to one aspect of the present invention, each of the weights in the first set wraps around or hooks the first end of the handle assembly, and each of the weights in the second set wraps around or hooks the second end of the handle assembly. In each set of weights, the weights may be configured and arranged so that hooks on weights near the handle stack on top of hooks on weights further from the handle. Alternatively, the hooks may be arranged to occupy discrete spaces extending beneath the weights.

According to another aspect of the present invention, at least one sensor is provided on the handle assembly for sensing which weights the selector is currently underlying, and an electronic display operatively connected to the sensor for displaying a weight amount based on the weight of the handle assembly and which weights the selector is currently underlying. A first sensor may be provided for weights selectively engaged in a first manner, and a second sensor may be provided for weights selectively engaged in a discrete, second manner.

According to yet another aspect of the present invention, a box-shaped weight is disposed about the first set of weights and the second set of weights, and a connector is movably mounted on the box-shaped weight for movement into and out of underlying and overlying engagement with the handle assembly. As noted above, a first sensor may be provided for sensing when the connector engages the handle assembly, and a second sensor may be provided for sensing which weights are engaged by the selector, so an electronic display may display the weight of the handle assembly and all of the weights secured thereto.

A base may be provided to support at least the weights at the ends of the handle assembly. The base may cooperate with the handle assembly to signal when the handle assembly is resting on the base, and when the handle assembly is removed from the base. Moreover, a latch may be provided on the handle assembly to prevent operation of the selector and/or the connector when the handle assembly is removed from the base.

According to still another aspect of the present invention, the handle defines a hand grip having a particular size and shape, and a hand grip supplement is releasably connected to the handle assembly directly beneath the hand grip, thereby defining a relatively larger and distinctly shaped alternative hand grip.

According to an additional aspect of the present invention, a base has a first end sized and configured to support the first set of weights, and a second end sized and configured to support the second set of weights, and an upwardly facing bearing surface. The handle assembly includes a member that aligns with and engages the bearing surface when the handle assembly is resting on the base. An electronic display is operatively connected to the member and presents a first visible signal to indicate that a person may safely operate the selector, because the handle assembly is resting on the base, and a second visible signal to indicate that it is unsafe for a person to operate the selector, because the handle assembly is removed from the base.

Various features and/or advantages of the present invention, including those described above, will become apparent from the more detailed description that follows.

BRIEF DESCRIPTION OF THE FIGURES OF THE DRAWING

With reference to the Figures of the Drawing, wherein like numerals represent like parts throughout the several views.

DETAILED DESCRIPTION OF A PREFERRED EMBODIMENT

Figure 1:
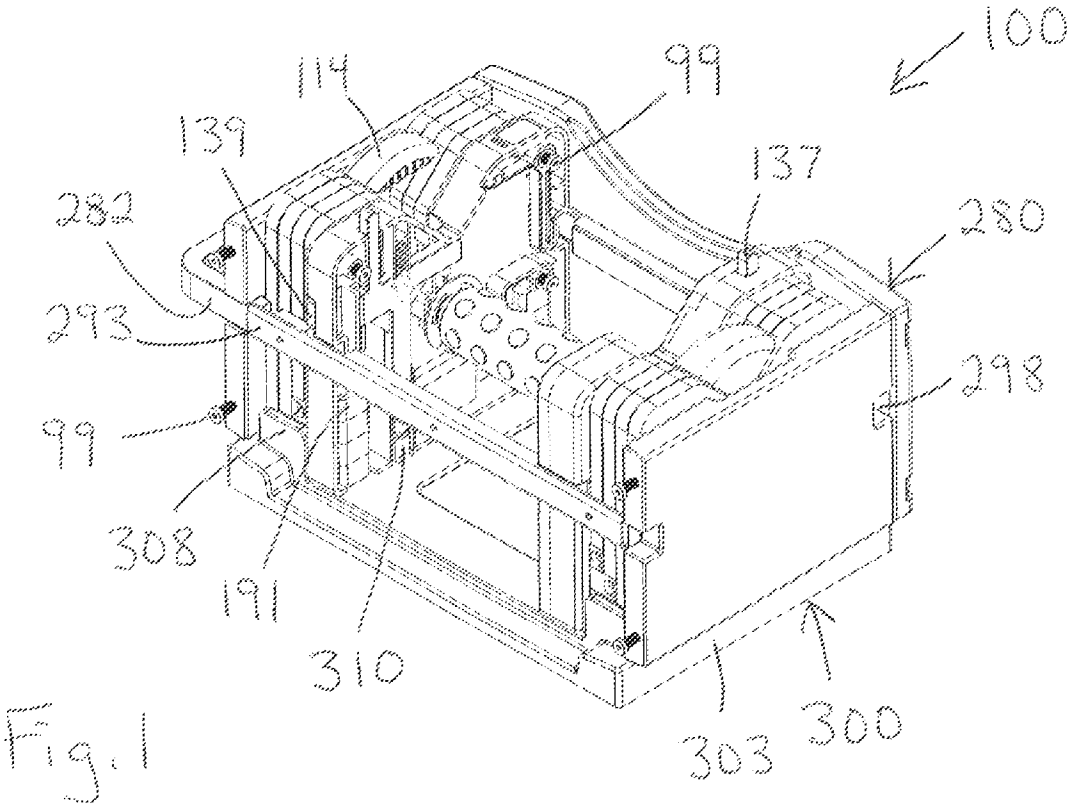
FIG. 1 is a perspective view of a preferred embodiment exercise dumbbell system constructed according to the principles of the present invention, with a side of box-shaped weight removed.

FIG. 1 shows an exercise dumbbell system 100 constructed according to the principles of the present invention (with two parts removed to better illustrate other parts). Generally speaking, the dumbbell system 100 includes a weight lifting member or handle assembly 110 (shown by itself in FIG. 4); two sets of weights 181-184 that are selectively secured to respective ends of the handle assembly 110 to define a selectively adjustable weight dumbbell; a box weight 280 selectively secured to both ends of the handle assembly 110 to define a relatively heavier adjustable weight dumbbell; and a base or tray 300 that supports the weights 181-184 and 280 and the handle assembly 110 when not in use.

Figure 4:
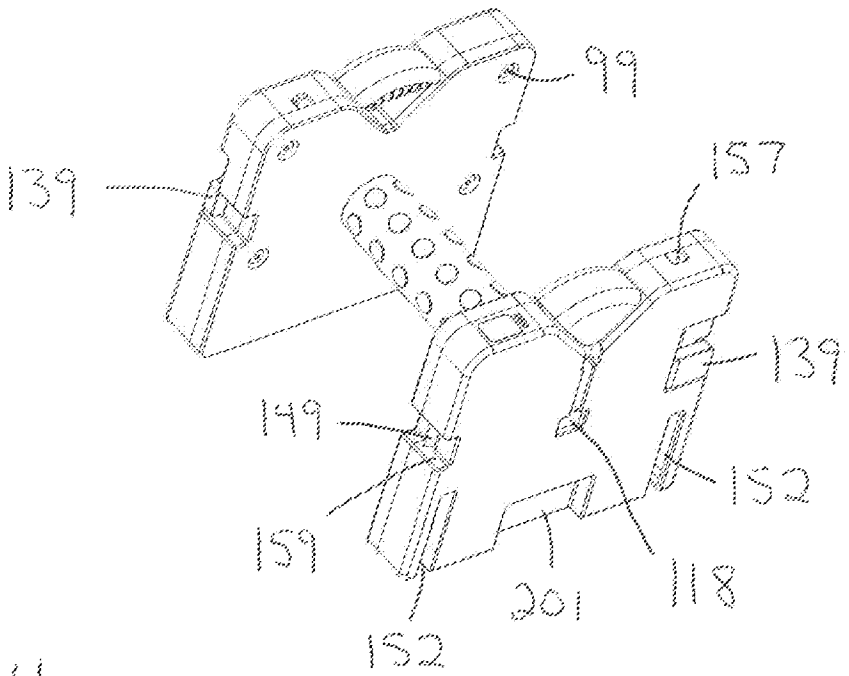
FIG. 4 is a perspective view of the exercise dumbbell system of claim 3, with all of the relatively smaller weights also removed, leaving an empty handle assembly.
Figure 5:
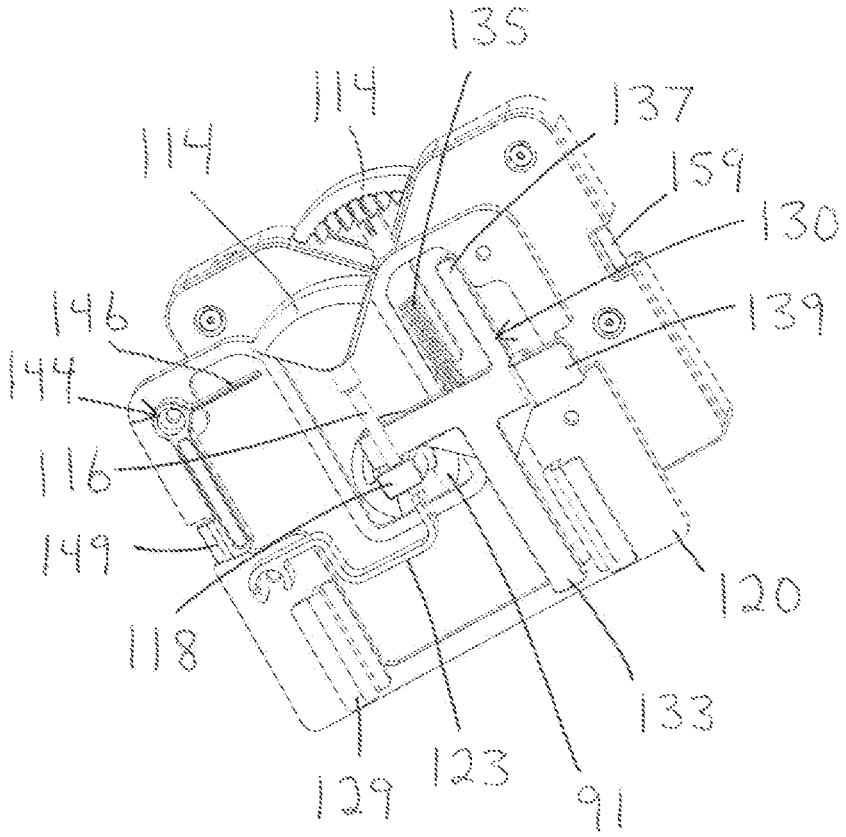
FIG. 5 is a perspective view of the empty handle assembly of FIG. 4, with an end cover removed to reveal internal components.
Figure 6:
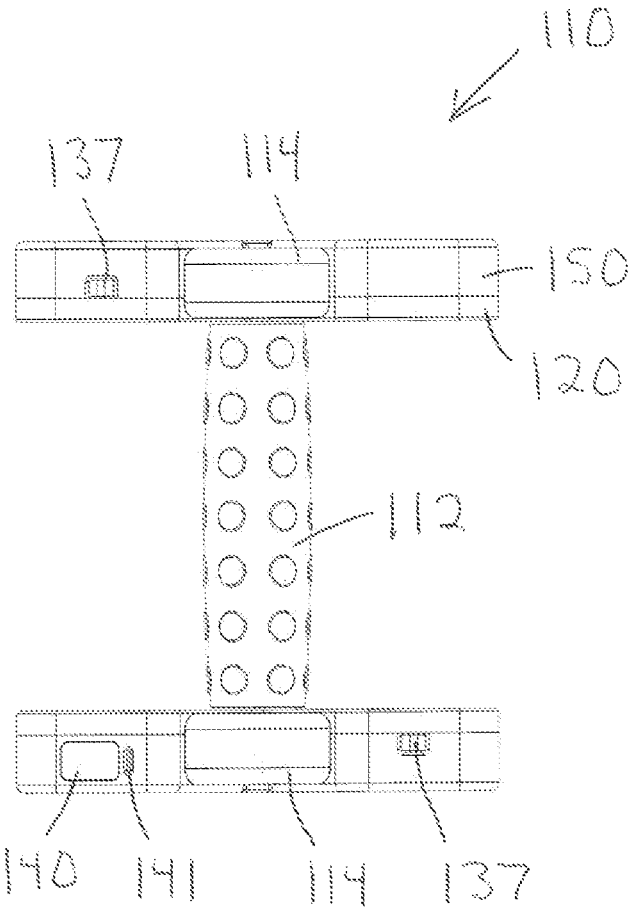
FIG. 6 is a top view of the empty handle assembly of FIG. 4.

FIGS. 4-6 show the handle assembly 110 by itself (with one of two outer end covers 150 removed in FIG. 5 to reveal interior components). In FIG. 1, one of two inner plates 120 is removed from the handle assembly 110. The handle assembly 110 includes a handle 112 that is sized and configured for grasping in a person's hand. The handle 112 preferably includes a rubber grip fitted over a cylindrical steel tube 111 (see FIGS. 9-11). The graspable portion of the handle 112 is preferably five inches long and up to one and one-quarter inches in diameter. A first end of the handle 112 is connected to a first cast iron plate 120, and an opposite, second end of the handle 112 is connected to a second cast iron plate 120. In this regard, a circumferential groove extends around each end of the tube 111, and a conventional C-clip 91 (see FIG. 5) is resiliently inserted into each groove to trap a respective plate 120 between the grip and a respective C-clip 91. Set screws may be threaded into the tube 111 to bear against inwardly facing surfaces of respective plates 120 and thereby reinforce the effect of the grip on the plates 120.

With reference to FIG. 5, first and second steel bars or weight selectors 118 are telescopically mounted inside the handle 112, and arranged end-to-end. At least an outboard segment of each bar 118 has the rectangular profile shown in FIG. 5. Each bar 118 is preferably keyed against rotation relative to the handle tube 111. Six upwardly opening and evenly spaced holes are formed in a line along the outboard segment of each bar 118. The outermost hole receives a steel rod or pin 116, which is secured in place by welding or other conventional means. An injection molded plastic user operator member or knob 114 is secured to an opposite end of the pin 116 by a transversely extending spring pin or other conventional means. The knob 114 may be described as generally wedge-shaped with an upwardly convex top surface, and downwardly diverging left and right sidewalls.

The remaining five holes in each bar 118 alternatively align with a downwardly extending peg on a plunger 130, as the bar 118 is withdrawn from the handle 112. Each plunger 130 is slidably mounted between a plate 120 and an injection molded plastic cover 150. Screws 99 (see FIG. 1) are inserted through the plate 120 and threaded into the cover 150 to capture the plunger 130 and certain other components therebetween. At each end of the handle member 110, a helical coil spring 135 is compressed between an upwardly facing portion of the plunger 130 and a downwardly facing portion of the cover 150 to bias the plunger 130 downward relative to the cover 150. Each plunger 130 includes a lower post 133 that is aligned longitudinally with a respective spring 135, and that defines a downwardly facing bearing surface. As shown in FIG. 1, each lower post 133 aligns with a respective peg 310 on the base 300 when the handle assembly 110 is resting in a ready position on the base 300. The weight of the handle assembly 110 is sufficient to overcome the force of each spring 135, thereby pressing the plungers 130 upward (and the associated pegs upward out of the holes in the bars 118). When the handle assembly 110 is removed from the base 300, the springs 135 push the plungers 130 downward (and the associated pegs downward into aligned holes in the bars 118).

Each plunger 130 also includes an upper post 137 that is adjacent the spring 135 and extends parallel thereto. As shown in FIG. 1, the upper posts 137 project upward past uppermost surfaces of respective plates 120 and covers 150, when the springs 135 are compressed. As shown in FIGS. 4 and 5, the upper posts 137 move to retracted positions within openings 157 in the covers 150, when the springs 135 expand (in response to removal of the handle assembly 110 from the base 300). Each plunger 130 also includes a gate 139 that projects laterally outward to a respective sidewall of a respective cover 150. For reasons further discussed below, the gate 139 covers or spans a notch 159 in the cover 150 when the handle assembly 110 is removed from the base 300, and moves upward above the notch 159 in the cover 150 when the handle assembly 110 is resting in a ready position on the base 300. Corresponding notches are formed in the plates 120, as well.

Downwardly opening holes in each bar 118 align with the upwardly opening holes in each bar 118 (and are preferably formed as continuous holes through the entire height of the bar 118). On each end of the handle assembly 110, all but the outermost downwardly opening hole alternatively align with an upwardly extending nub on a free end of a respective leaf spring 123. An opposite, anchored end of each leaf spring 123 is secured in place between a respective plate 120 and a respective cover 150. As a bar 118 is withdrawn from the handle 112, the nub on the leaf spring 123 functions as a detent mechanism to help a user sense when an upwardly opening hole in the bar 118 is aligned with the peg on the plunger 130. The nub on each leaf spring 123 is sized and configured to resiliently deflect into and out of the downwardly opening holes as the bar 118 slides longitudinally, whereas the peg on each plunger 130 is sized and configured to remain in any of the upwardly opening holes in a respective bar 118 to lock the bar 118 against longitudinal sliding.

Each end of the handle assembly 110 also has a generally L-shaped pivot member 144 that is preferably injection molded plastic. An intermediate portion of each pivot member 144 is pivotally retained between a respective plate 120 and a respective cover 150. Each pivot member 144 has a first leg 146 that extends horizontally beneath an electrical contact on a respective cover 150 (shown diagrammatically in FIG. 8). A similar electrical contact is disposed on the end of the first leg 146 for movement into contact with the contact on the cover 150 in response to pivoting of the pivot member 144. Each contact is connected by a respective wire to a controller 142 that includes a power source. Each pivot member 144 has a second leg 149 that extends vertically and spans or covers a notch 159 in a respective cover 150 (opposite the notch 159 spanned by the gate 139 on the plunger 130) and a corresponding notch in a respective plate 120.

Figure 2:
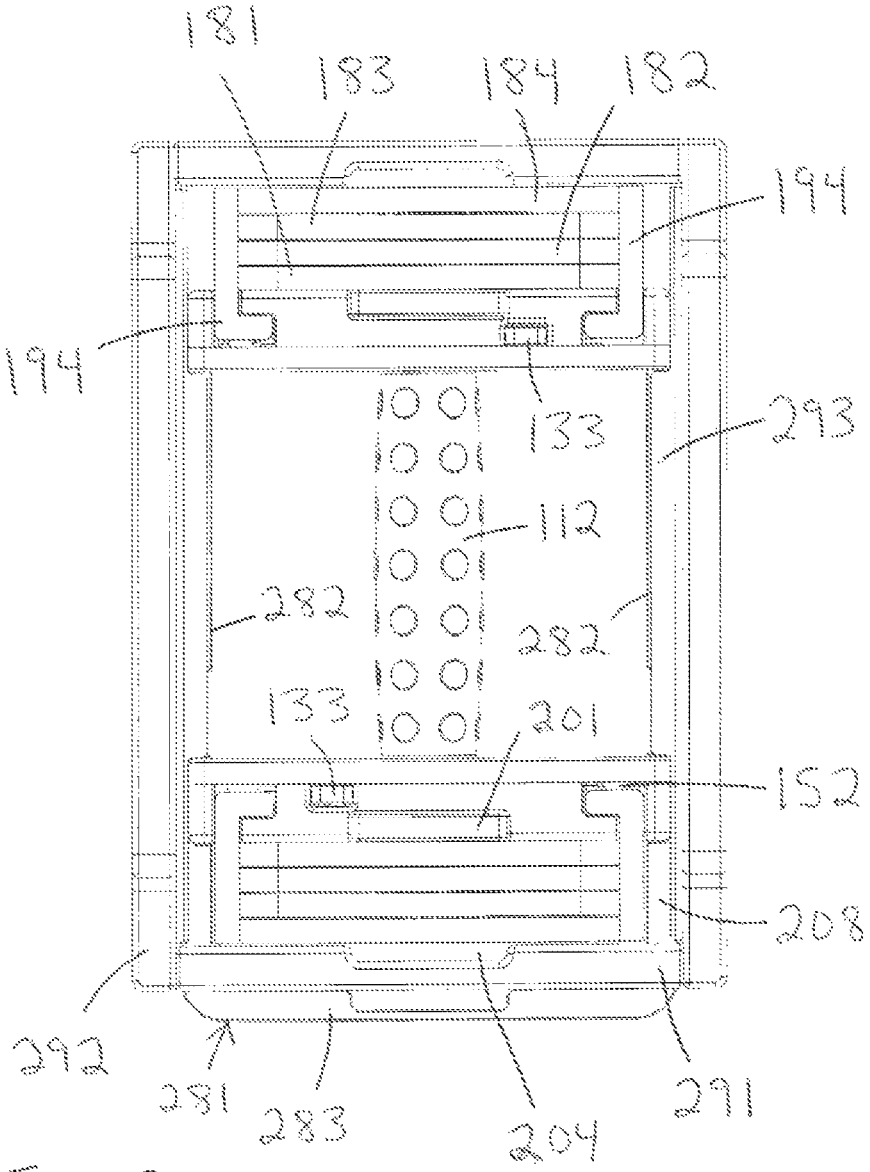
FIG. 2 is a bottom view of the exercise dumbbell system of FIG. 1, with an underlying base removed and the side of the box-shaped weight shown.

FIG. 5 also shows first and second stamped steel flanges 129 welded onto the outboard side of each plate 120. Each pair of flanges 129 cooperates with a respective plate 120 to define cavities that receive first and second hooks 191-194 on one set of weights 181-184, as further described below. As shown in FIG. 2, these cavities are accessible from below via slots 152 in the covers 150.

Figure 7:
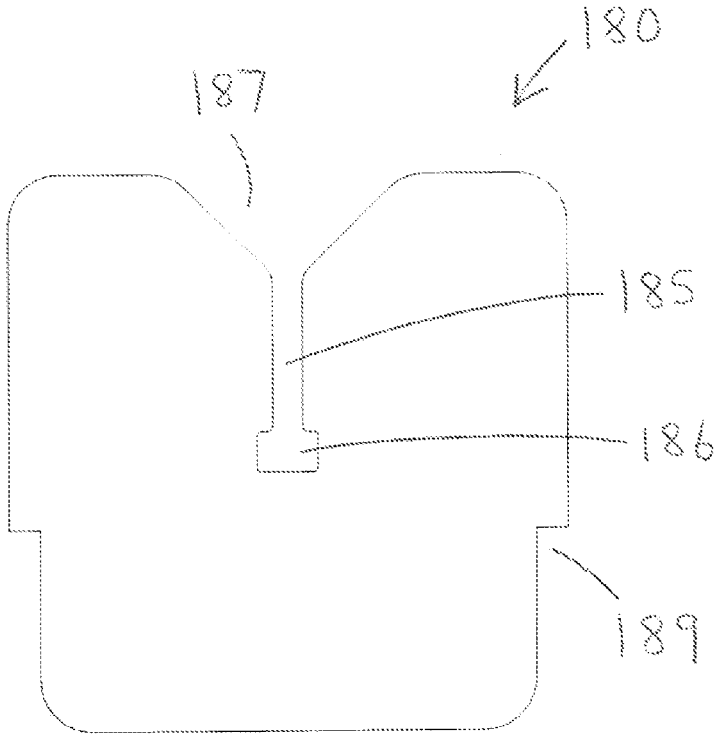
FIG. 7 is an end view of a stamped metal plate that forms a part of each of the smaller weights shown in FIG. 3.

FIG. 7 shows a primary component 180 of one of the weights 181 by itself. The primary component 180 is preferably a stamped steel plate that weights a little less than 2.5 pounds. The plate 180 has a central, upwardly open slot 185 that extends through the entire thickness of the plate 180. A lower or internal end of the slot 185 terminates at a relatively wider rectangular opening 186. An opposite, upper or external end of the slot 185 terminates at upwardly diverging sidewalls that define an upwardly opening notch 187 to accommodate the sidewalls of a knob 114. An opposite, bottom edge of the plate 180 is flat. Opposite left and right sidewalls of the plate 180 extend perpendicular to the bottom edge. Downwardly and laterally opening notches 189 extend into the lower ends of the sidewalls of the plate 180. The other weights 182-184 have plates similar to the plate 180, except the notches are relatively shorter in height as a function of distance from the lifting member 110. In other words, the weights 184 have the plates with the shortest notches.

Figure 3:
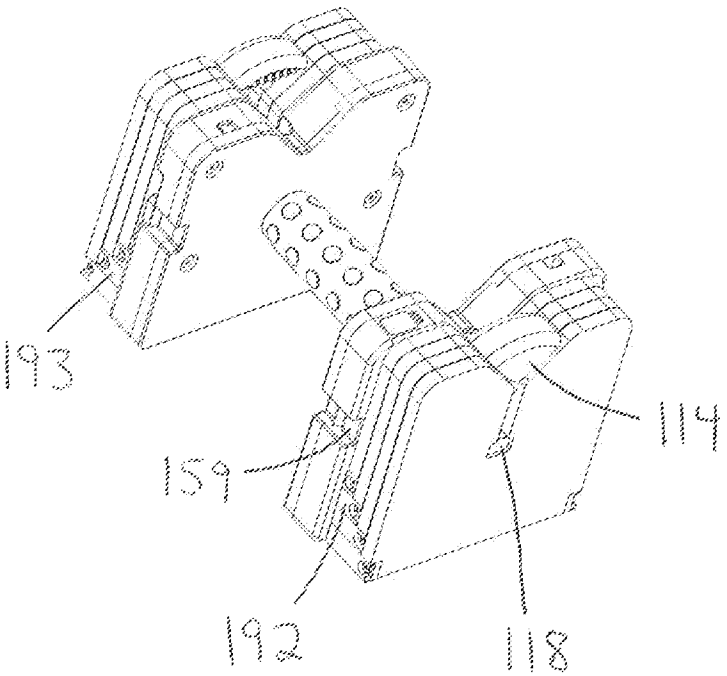
FIG. 3 is a perspective view of the exercise dumbbell system of FIG. 1, with the base and all of the box-shaped weight removed.

First and second L-shaped hooks 191-194 are connected to first and second sides of respective plates. FIG. 2 shows the hooks 194 on the weights 184. The hooks on the other weights 181-183 are similar but relatively longer in length as a function of distance from the lifting member 110. In other words, the weights 184 have the longest hooks. Each hook 191-194 is secured within an upper inside corner of a respective notch by means of a screw 99 inserted through the hook and threaded into the sidewall of a respective plate 181-184. As shown in FIGS. 1-3, the hooks 191-194 are configured and arranged to stack on top of one another when the plates are arranged in a horizontal array with the openings 186 aligned with one another.

As shown in FIGS. 1-2, the box-shaped weight 280 forms a box about the lifting member 110 and the weights 181-184. In this regard, the box-shaped weight 280 includes left and right end panels 291 that are mirror images of one another, and first and second side panels 292 that are mirror images of one another. All of the panels 291 and 292 are preferably cast iron parts. The end panels 291 are disposed between the ends of the side panels 292 and secured in place by screws that thread through openings in the side panels 292 and into openings in the end panels 291. A U-shaped connector 281 is slidably connected to the interconnected panels 291 and 292. The connector 281 has first and second prongs 282 and an intermediate handle portion 283 extending therebetween. The prongs 282 slide into notches 298 in the end panels 291 and along channels defined by the side panels 292. The channels are preferably defined by U-shaped rails 293 that are screwed to respective side panels 291 (see FIG. 1).

The prongs 282 have relatively thicker and thinner segments, as viewed from above. Opposing relatively thinner segments define a gap therebetween that is wider than the lifting member 110, while opposing relatively thicker segments define a gap therebetween that is narrower than the lifting member. FIG. 1 shows the box-shaped weight 280 aligned with the lifting member 110, and the connector 281 occupying a disengaged position relative to the lifting member 110, with relatively thinner segments of the prongs 282 aligned with the notches in the lifting member 110. FIG. 2 shows the box-shaped weight 280 aligned with the lifting member 110, and the connector 281 occupying an engaged position relative to the lifting member 110, with relatively thicker segments of the prongs 282 occupying the notches in the lifting member 110. In FIG. 2, the handle member 283 is relatively closer to the end panel 291 of the box-shaped weight 280.

The base 300 is preferably an injection molded plastic member designed to efficiently hold all of the weights 181-184 and 280 in respective ready positions for engagement by respective members on the handle assembly 110. The base 300 includes a bottom 303 sized and configured to occupy a stable rest position on a flat support surface, and to underlie at least portions of all of the weights 181-184 and 280 in respective ready positions. The base 300 also includes upwardly extending walls or flanges 308 configured and arranged to retain all of the weights 181-184 and 280 against movement in any direction parallel to the bottom 303. FIG. 2 shows gaps or spaces 208 (outside the hooks 191-194) sized and configured to receive respective flanges 308, and other gaps or spaces 201 and 204 sized and configured to receive other upwardly extending walls on the base 300, adjacent to weights 181 and 184, respectively.

On the depicted embodiment 100, the handle assembly 110 is configured to weigh 5 pounds; each of the weights 181-184 is configured to weigh 2.5 pounds; and the box-weight 280 is configured to weigh 25 pounds. As a result, the embodiment 100 provides a dumbbell that adjusts from 5 to 50 pounds in balanced increments of 5 pounds, and out-of-balance increments of 2.5 pounds. FIG. 4 shows the dumbbell having a first length when it weighs 5 pounds. FIG. 3 shows the dumbbell having a relatively greater length when it weighs 25 pounds. FIG. 2 shows the dumbbell having a still greater length, and a relatively greater width, when it weighs at least 30 pounds.

FIG. 1 shows the handle assembly 110 and all of the weights 181-184 and 280 on the base 300. The tips of the plunger posts 137 are projecting upward through the openings 157 in the covers 150, signaling that the dumbbell system 100 is currently in an adjustable mode, with the bars 118 and the connector 281 free to slide into and out of engagement with the weights 181-184 and 280, respectively. The knobs 114 are currently set at their maximum settings, and the connector 281 is currently disengaged from the handle assembly 110. Proximate the enumerated plunger gate 139, a relatively thicker segment of the connector prong 282 is disposed between two relatively thinner segments of the connector prong 282. In other words, a notch in the connector prong 282 is currently aligned with the cover 150 (and the removed plate 120), and when the relatively thicker segment of the connector prong 282 is moved into alignment with the cover 150 (and the removed plate 120), a second notch will come into alignment with the gate 139. As a result, when the connector 280 is moved to the position shown in FIG. 2, and the handle assembly 110 is removed from the base 300, the gate 139 will slide into the notch in the connector prong 282 to prevent sliding of the connector 281 when the handle assembly 110 and the box-weight 280 are interconnected and removed from the base 300. In other words, the plungers 130 block movement of both the bars 118 and the connector 281 in a manner that prevents any weights 181-184 or 280 from being accidentally released from the handle member 110 during exercise.

Figure 8:
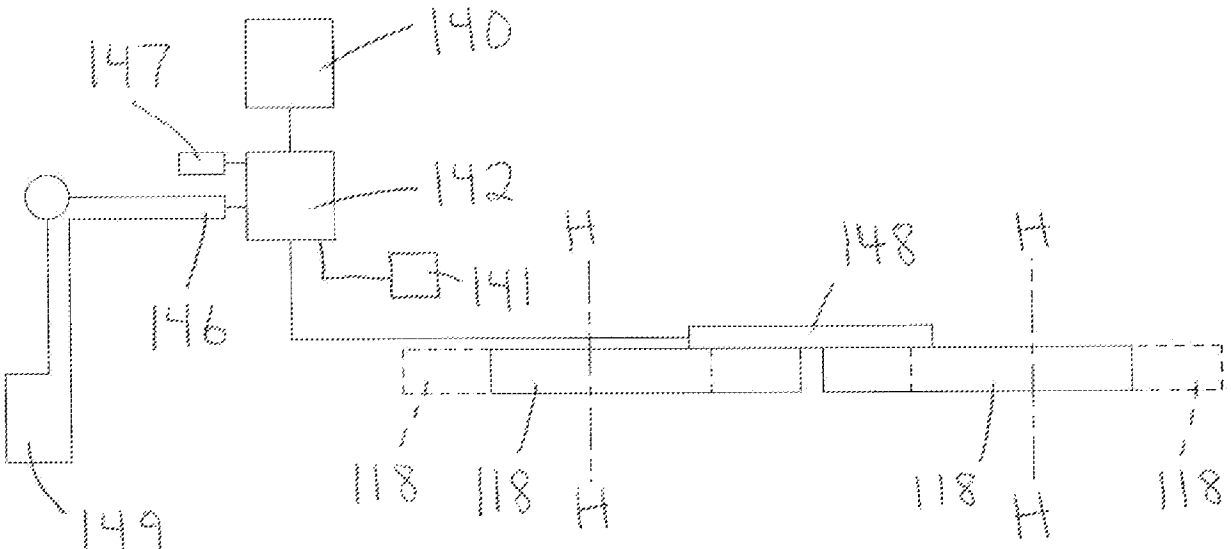
FIG. 8 is a schematic diagram of a sensor and display system incorporated into the handle assembly of FIG. 4.

The handle assembly 110 includes electronic components for displaying how much force is required to lift the handle assembly 110 and any engaged weights 181-184 or 280 from the base 300. FIG. 8 provides a schematic diagram of the components and how they are interconnected. A first electrical contact is mounted on the first leg 146 of the pivot member 144, and is connected to a controller/power source 142 via at least one wire (which is long enough and flexible enough to accommodate arcuate movement of the first leg 146). Immediately above the contact on the first leg 146, a second electrical contact 147 is mounted inside the cover 150 and connected to the controller/power source 142 via at least one wire. When a thicker segment of the connector prong 282 occupies the notch 159 in the cover 150, the pivot member 144 pivots, and the two electrical contacts touch one another to complete a circuit and inform the controller/power source 142 that the box-weight 280 is connected to the handle assembly 110.

An electronic telescoping assembly or sensor 148 is interconnected between the bars 118, and connected to the controller/power source 142 via at least one wire. FIG. 8 shows the bars 118 in solid lines in their minimum weight engaging positions, and in dashed lines in their maximum weight engaging positions, relative to the graspable portion of the handgrip 112, which is disposed between the reference lines H-H. The sensor 148 includes a channel member mounted on one of the bars 118, and a rod mounted on the other bar 118. An electrical contact is mounted on the rod, and an array of eight electrical contacts is mounted on the channel member. When the bars 118 are set as shown in solid lines in FIG. 8 (see FIG. 4, as well), the rod contact is touching the outermost channel contact, and a corresponding signal is sent to the controller/power source 142 indicating that no weights 181-184 are engaged. Each time either bar 118 is moved outward an increment equal in length to the thickness of a weight plate 180, the rod contact comes into contact with an inwardly adjacent channel contact, and a corresponding signal is sent to the controller/power source 142 indicating that a 2.5-pound weight has been engaged. After eight such movements, the bars 118 are set as shown in dashed lines in FIG. 8 (see FIG. 3, as well), and the rod contact is touching the innermost channel contact, and a corresponding signal is sent to the controller/power source 142 indicating that all of the weights 181-184 are engaged.

The controller/power source 142 uses information received (or not received) from the sensors 147 and 148 to calculate the aggregate weight of the handle assembly 110 and any and all weights 181-184 and 280 connected to the handle assembly 110. The controller/power source 142 is connected to an LCD display 140 via at least one wire. In response to power and data received from the controller/power source 142, the display 140 displays a weight amount between 5 and 50 pounds. A power switch or button 141 is connected to the controller/power source 142 via at least one wire, and the button 141 is operable to activate and deactivate the controller/power source 142 for purposes of conserving power (in the form of one or more conventional batteries). As shown in FIG. 6, the display 140 and the power button 141 are accessible through adjacent openings in an upper wall of one of the covers 150. With the exception of the foregoing circuitry and the connector 281, one end of the dumbbell system 100 is a rotated copy of the other end of the dumbbell system 100.

Figure 9:
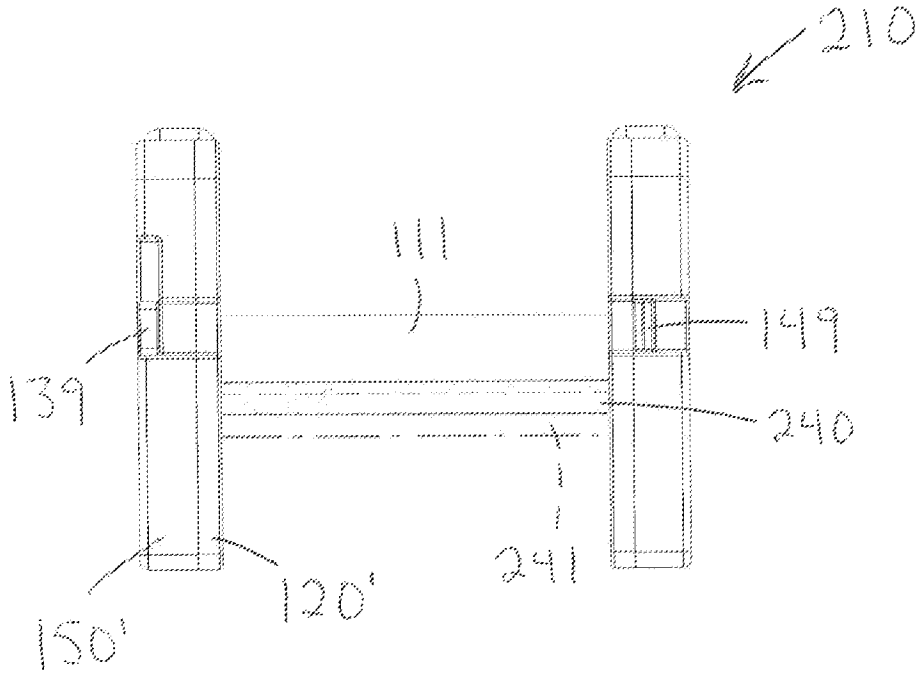
FIG. 9 is a side view of an alternative embodiment handle assembly that may be substituted for the handle assembly of FIG. 4 to arrive at an alternative embodiment of the present invention.
Figure 10:
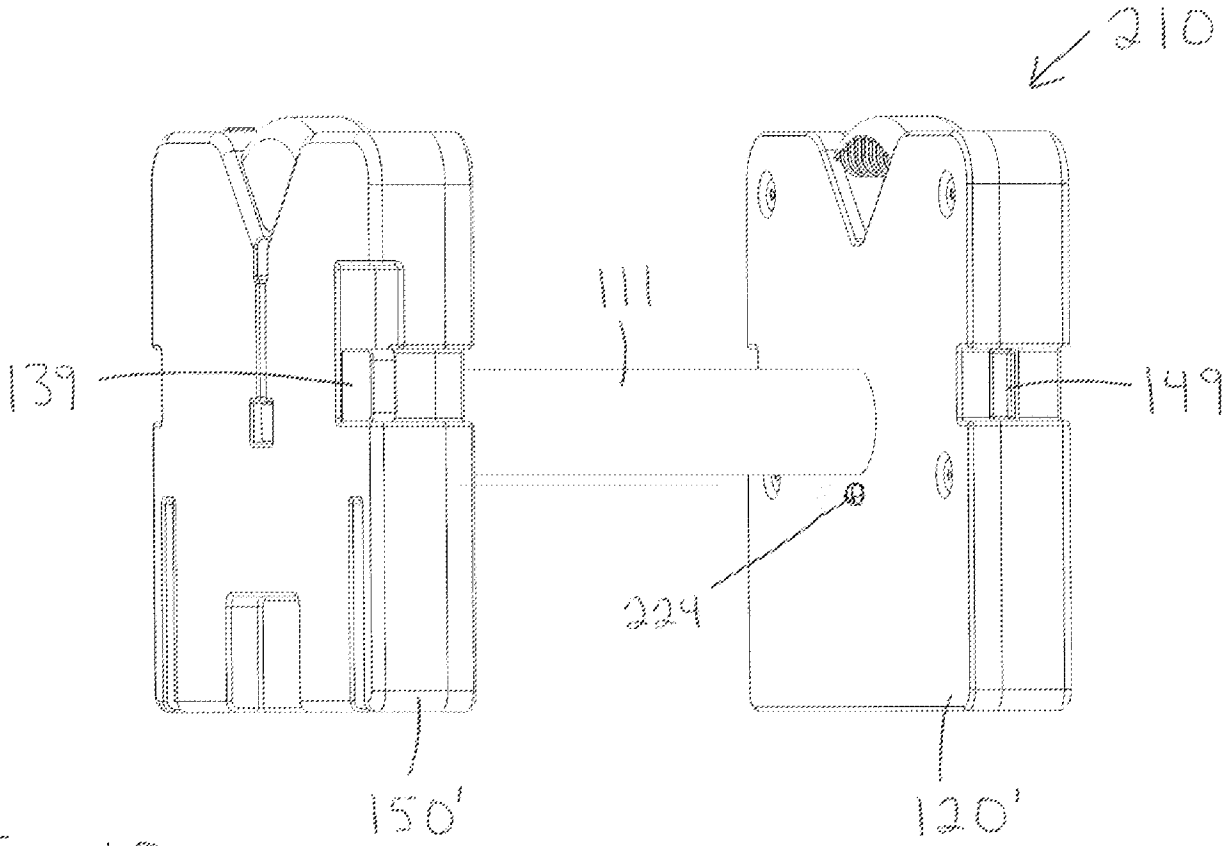
FIG. 10 is a perspective view of the handle assembly of FIG. 9.
Figure 11:
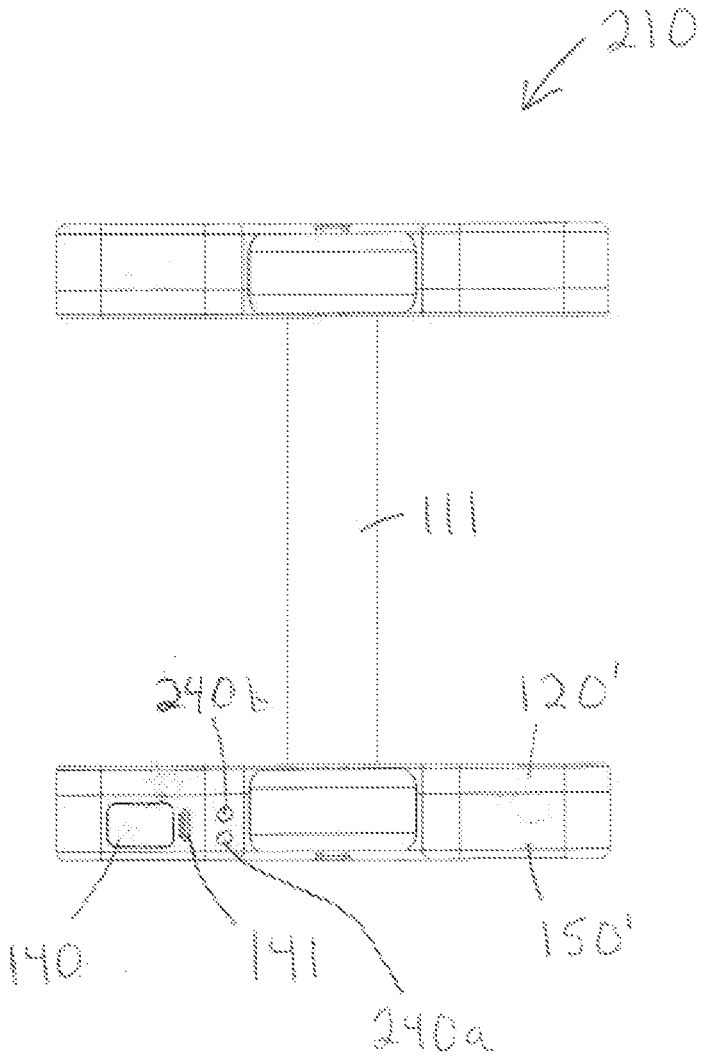
FIG. 11 is a top view of the handle assembly of FIG. 9.

FIGS. 9-11 show an alternative embodiment handle assembly 210 that may be substituted for the handle assembly 110 on the dumbbell system 100. The handle assembly 210 is identical to the handle assembly 110 except as shown in FIGS. 9-11 and described below. A difference regarding the handle involves leaving the handle tube 111 exposed on the handle assembly 210, and preferably lightly knurling the handle tube 111 for gripping purposes. A difference regarding each of the plates 120' is the addition of a small opening 224 (see FIG. 10) in each plate 120' beneath a respective end of the handle tube 111.

FIG. 9 shows a first hand grip supplement 240 in solid lines and a lower edge of an alternative, second hand grip supplement 241 is represented by a line of alternating long and short dashes. A hidden lower edge of the handle tube 111 is represented by a line of approximately equal length dashes. Each supplement 240 and 241 preferably includes a plastic rod or spine, and a rubber block disposed about all but opposite first and second ends of the spine. The assembly is flexible enough to accommodate insertion of the protruding plastic ends into the openings 224. Each supplement 240 and 241 preferably has an upper concave surface that mates with and abuts a lower portion of the handle tube 111, and a lower convex surface that matches the lower portion of the handle tube 111. Each supplement 240 and 241 also preferably includes opposite first and second sidewalls that extend between the upper and lower curved surfaces. The hand grip supplement 240 enlarges the profile of the resulting handle a first amount, and the hand grip supplement enlarges the profile of the resulting handle a relatively greater, second amount.

Differences regarding the covers 150' include elimination of the openings 157 for the plunger posts 137 (which are not present on this embodiment), and the provision of additional display windows or lights **240*a* and 240*b*. The display 240*a* is preferably a red LED that is connected to the controller/power source 142 via at least one wire. The display 240*b* is preferably a green LED that is connected to the controller/power source 142 via at least one wire. On an alternative embodiment, each display 240*a* and 240*b* includes a white light disposed beneath an appropriately colored lens or window. In either case, the controller/power source 142 illuminates the display 240*a* when the power is on and the handle assembly 210 is removed from the base 300, signaling that it is not an appropriate time to operate any of the weight adjusting members 114 or 281. Conversely, the controller/power source 142 illuminates the display 240*b* when the power is on and the handle assembly 210 is resting on the base 300, signaling that it is an appropriate time to operate the weight adjusting members 114 and 281**.

The controller/power source 142 switches between the display **240*a* and the display 240*b* as a function of the location of a modified plunger. In this regard, a first electrical contact is disposed on a shortened upper post on the plunger, and a second electrical contact is disposed on the free end of a leaf spring mounted inside the cover 150' (to provide tolerance for movement of the plunger). When the peg 310 on the base 300 pushes the plunger upward, the first electrical contact touches the second electrical contact, thereby signaling to the controller/power source 142 that the handle assembly 210 is resting on the base 300. When the handle assembly 210 is removed from the base 300, the plunger moves the first electrical contact out of touch with the second electrical contact, thereby signaling to the controller/power source 142 that the handle assembly 210 is removed from the base 300**.

The present invention may be described and/or interpreted with reference to alternative terms and/or arrangements that are functionally equivalent to those specifically mentioned above. All of the patents identified in the Background of the Invention are incorporated herein by reference for purposes of supporting and broadening this disclosure with regard to any and all features and/or components of the present invention that are disclosed in any or all of those prior art references. Recognizing that this disclosure will enable persons skilled in the art to derive additional modifications, improvements, and/or applications that nonetheless embody the essence of the invention, the scope of the present invention is to be limited only to the extent of the following claims.

What is claimed is:

1. An exercise dumbbell, comprising:

a first set of weights;

a second set of weights; and a handle assembly including at least one weight selector that is moved into and out of operable engagement with individual weights of the first and second sets of weights, and at least one sensor that measures the position of the at least one weight selector relative to the handle assembly.

2. The exercise dumbbell of claim 1, further comprising a discrete weight disposed proximate the handle assembly, a connector mounted on the discrete weight and movable into and out of interlocking engagement with the handle assembly, wherein the handle assembly includes a connector sensor for sensing when the connector engages the handle assembly, and generating a signal that adds the weight of the discrete weight to a weight amount when the handle assembly is engaged by the connector.

3. The exercise dumbbell of claim 2, wherein:

the handle assembly includes a controller/power source, and further comprising:

the at least one sensor connected to the controller/power source;

the connector sensor connected to the controller/power source;

the controller/power source receiving information received from the at least one sensor and the connector sensor to calculate the aggregate weight of the handle assembly and the weights from the first and second sets of weights connected to the handle assembly and the weight of the discrete weight if engaged; and the aggregate weight amount is shown on a display.

4. The exercise dumbbell of claim 1, wherein the at least one weight selector includes a first weight selector movable into underlying engagement with the first set of weights, and a second weight selector movable into underlying engagement with the second set of weights.

5. The exercise dumbbell of claim 4, wherein the at least one sensor is mounted on the first weight selector and the second weight selector, and changes in position of the first weight selector relative to the second weight selector signal a change in a weight amount.

6. The exercise dumbbell of claim 4, wherein the at least one sensor is telescopically mounted between the first weight selector and the second weight selector.

7. The exercise dumbbell of claim 1, further comprising a display operatively connected to the handle assembly, wherein the display presents a first visible signal upon the handle assembly being engaged with a base to indicate that said at least one weight selector is adjustable, and the display alternatively presents a second visible signal upon the handle assembly being disengaged from the base to indicate that said at least one weight selector is not adjustable.

8. The exercise dumbbell of claim 1, further comprising a box-shaped weight disposed about the first set of weights and the second set of weights, wherein:

a connector on the box-shaped weight is movable into and out of engagement with the handle assembly;

the handle assembly is disposed between the first set of weights and the second set of weights; and the at least one weight selector moves into and out of underlying engagement with each weight of the first and second sets of weights.

9. The exercise dumbbell of claim 8, wherein the handle assembly includes a handle having a first end connected to a first end member, and a second end connected to a second end member, and the connector is movable into and out of engagement with at least one notch in each of the first end member and the second end member.

10. The exercise dumbbell of claim 8, further comprising a base having a first end sized and configured to support the first set of weights, and a second end sized and configured to support the second set of weights, and at least one peg that aligns with a movable plunger on the handle assembly, wherein as the handle assembly is received in the base, the plunger engages the peg and allows movement of the connector relative to the handle assembly, and wherein as the handle assembly is removed from the base, the plunger disengages from the peg and prevents movement of the connector out of engagement with the handle assembly.

11. The exercise dumbbell of claim 1 wherein each of the weights in the first set of weights wraps around a first end of the handle assembly, and each of the weights in the second set of weights wraps around an opposite, second end of the handle assembly.

12. The exercise dumbbell of claim 11, wherein:

each weight in the first and second sets of weights includes a plate, a stem that extends perpendicularly away from the plate, and a tab that extends perpendicularly away from the stem; and each stem associated with each weight in the first set of weights is a different length.

13. The exercise dumbbell of claim 1, wherein the at least one weight selector is moved into and out of engagement with individual weights of the first and second sets of weights by sliding the at least one weight selector.

14. The exercise dumbbell of claim 13, wherein:

the handle assembly includes a handle; and the at least one weight selector is mounted inside the handle and slides telescopically relative to the handle.

15. The exercise dumbbell of claim 1, further comprising:

a discrete weight selectively engaged with the handle assembly by a connector member;

a connector sensor mounted on the handle assembly for detecting the state of engagement of the discrete weight; and the connector sensor generating a signal that adds the weight of the discrete weight to a weight amount when the discrete weight is engaged with the handle assembly.

16. The exercise dumbbell of claim 15, wherein:

the handle assembly includes a controller/power source, and further comprising:

the at least one sensor connected to the controller/power source;

the connector sensor connected to the controller/power source;

the controller/power source receiving information received from the at least one sensor and the connector sensor to calculate the aggregate weight of the handle assembly and the weights from the first and second sets of weights connected to the handle assembly and the weight of the discrete weight if engaged; and the aggregate weight amount is shown on a display.

17. The exercise dumbbell of claim 1, further comprising an electronic display that is operatively associated with the at least one sensor and that displays a weight amount based on information from the at least one sensor regarding the position of the at least one weight selector relative to the handle assembly.

18. The exercise dumbbell of claim 17, wherein the electronic display is disposed on the handle assembly.

19. An exercise dumbbell, comprising:

a first set of weights;

a second set of weights;

a base having a first end sized and configured to support the first set of weights, and a second end sized and configured to support the second set of weights, and an upwardly facing bearing surface; and a handle assembly including at least one weight selector that moves into and out of operable engagement with individual weights of the first and second sets of weights, at least one sensor that measures the position of the at least one weight selector relative to the handle assembly, wherein the location of the at least one weight selector indicates which weights from the first and second sets of weights are coupled to the handle assembly, and a member that aligns with and engages the bearing surface when the handle assembly is resting on the base.

20. The exercise dumbbell of claim 19, further comprising an electronic display that presents a first visible signal upon the handle assembly being engaged with the base to indicate that the weight selector is adjustable, and a second visible signal upon the handle assembly being disengaged from the base to indicate that the weight selector is not adjustable.

21. The dumbbell of claim 20, wherein the display illuminates a green light to generate the first visible signal and illuminates a red light to generate the second visible signal.

22. The dumbbell of claim 20, further comprising a power source operatively connected to the display, and a switch operatively interconnected between the power source and the display.

23. The exercise dumbbell of claim 19, wherein:

the handle assembly includes a handle; and the at least one weight selector longitudinally slides within at least a portion of the handle.

* * * * *